United States Patent [19]

Ono et al.

[11] 3,930,851

[45] Jan. 6, 1976

[54] ELECTROPHOTOGRAPHIC PROCESS USING METHYLENE INDOLINE PHOTOCONDUCTIVE DERIVATIVES

[75] Inventors: Hisatake Ono; Syu Watarai; Harumi Katsuyama, all of Asaka, Japan

[73] Assignee: Fuji Photo Film Co., Ltd., Kanagawa, Japan

[22] Filed: Mar. 28, 1974

[21] Appl. No.: 455,797

Related U.S. Application Data

[63] Continuation-in-part of Ser. No. 187,190, Oct. 6, 1971, Pat. No. 3,850,949.

[52] U.S. Cl. ..... 96/1 R; 96/1.5; 96/1.6; 96/90 PC

[51] Int. Cl.[2] ..... G03G 13/22; G03G 5/06

[58] Field of Search ..... 96/1.5, 1 R, 1.6, 90 PC

[56] References Cited

UNITED STATES PATENTS

| | | | |
|---|---|---|---|
| 3,441,410 | 9/1969 | Bryanko | 96/1.5 X |
| 3,527,602 | 9/1970 | Fox et al. | 96/1.5 X |
| 3,532,638 | 10/1970 | Otis | 96/90 PC |
| 3,647,428 | 3/1972 | Ono et al. | 96/1.5 |
| 3,660,086 | 5/1972 | Tamai et al. | 96/90 PC |
| 3,684,506 | 8/1972 | Guarnaccio | 96/1.5 X |
| 3,707,369 | 12/1972 | Ono et al. | 96/1.5 |
| 3,730,711 | 5/1973 | Ono et al. | 96/1.5 |

*Primary Examiner*—Roland E. Martin, Jr.
*Attorney, Agent, or Firm*—Gerald J. Ferguson, Jr.; Joseph J. Baker

[57] ABSTRACT

An electrophotographic member comprising a resin binder and an organic photoconductive composition and a process using the electrophotographic member, the composition consisting essentially of a compound of the formula (A), its dimeric compound or its polymeric compound:

(A)

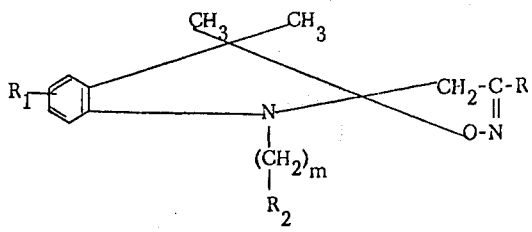

Wherein $R_1$ is hydrogen atom, halogen atom, alkyl group having 1 to 4 carbon atoms, alkoxy group having 1 to 4 carbon atoms, alkoxycarbonyl group having alkyl group 1 to 4 carbon atoms, nitro group, alkylene group having 1 to 3 carbon atoms which is capable of forming a bis-compound, or a bond which is capable of forming a bis-compound, $R_2$ is hydrogen atom, hydroxyl group, alkoxycarbonyl group having alkyl group of 1 to 4 carbon atoms, cyano or phenyl group, R is substituted phenyl group (where substituted group is hydrogen atom, halogen atom, alkyl group having 1 to 4 carbon atoms, or alkoxy group having 1 to 4 carbon atoms), alkylene group having 1 to 3 carbon atoms which is capable of forming a bis-compound, phenylene group which is capable of forming a bis-compound, or a bond which is capable of forming a bis-compound, and *m* is an integer from 1 to 4.

8 Claims, No Drawings

ELECTROPHOTOGRAPHIC PROCESS USING METHYLENE INDOLINE PHOTOCONDUCTIVE DERIVATIVES

REFERENCE TO RELATED APPLICATION

This is a continuation-in-part of U.S. Patent application Ser. No. 187,190 filed Oct. 6, 1971, now U.S. Pat. No. 3,850,949.

BACKGROUND OF THE INVENTION

This invention relates to an electrophotographic member containing an organic photoconductive material and a process using the same. As photoconductive materials applicable to electrophotography there are known inorganic substances such as selenium and zinc oxide, organic lower molecular compounds such as anthracene, chrysene and benzidine, and higher molecular compounds such as poly-N-vinylcarbazole, polyvinylnaphthalene and polyvinylanthracene.

DESCRIPTION OF PREFERRED EMBODIMENTS

This invention relates to an electrophotographic member comprising a resin binder and an organic photoconductive material having a novel structure completely different from known materials and a process for using the electrophotographic member. The material has as an essential component 2-substituted-methylene-indoline derivatives represented by the following general formula (A), its dimeric compound or its polymeric compound:

(A)

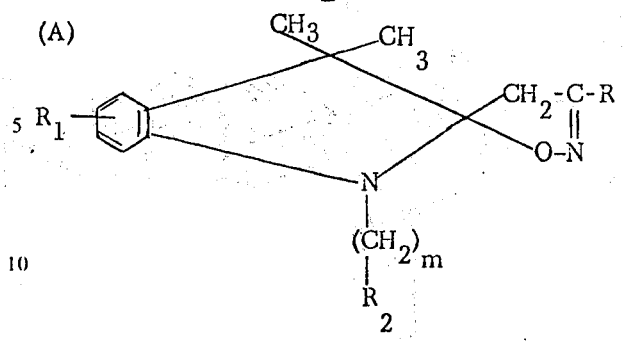

wherein $R_1$ is hydrogen atom, halogen atom, alkyl group having 1 to 4 carbon atoms, alkoxy group having 1 to 4 carbon atoms, alkoxycarbonyl group having alkyl group of having 1 to 4 carbon atoms, nitro group, alkylene group having 1 to 3 carbon atoms which is capable of forming a bis-compound, or a bond which is capable of forming a bis-compound, $R_2$ is hydrogen atom, hydroxyl group, alkoxycarbonyl group having alkyl group of 1 to 4 carbon atoms, cyano or phenyl group, R is substituted phenyl group (wherein substituted group is hydrogen atom, halogen atom, alkyl group having 1 to 4 carbon atoms or alkoxy group having 1 to 4 carbon atoms), alkylene group having 1 to 3 carbon atoms which is capable of forming a bis-compound phenylene group which is capable of forming a bis-compound, or a bond which is capable of forming a bis-compound, and m is an integer from 1 to 4.

The above general formula (A) is represented by the following formulas (I) to (IV).

(I)

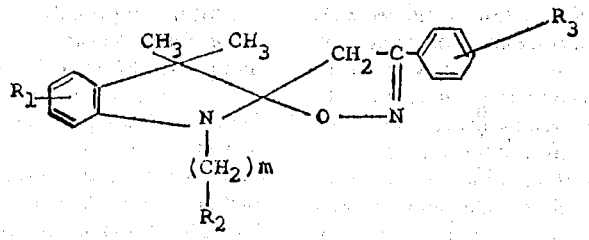

(II)

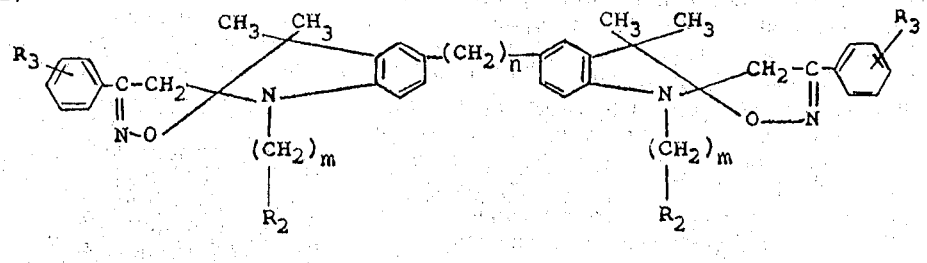

(III)

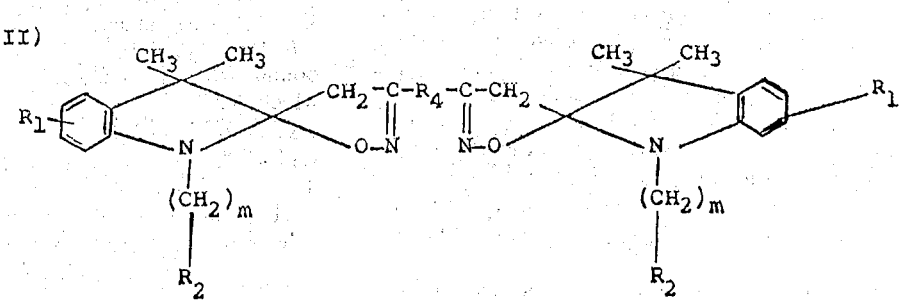

(IV)

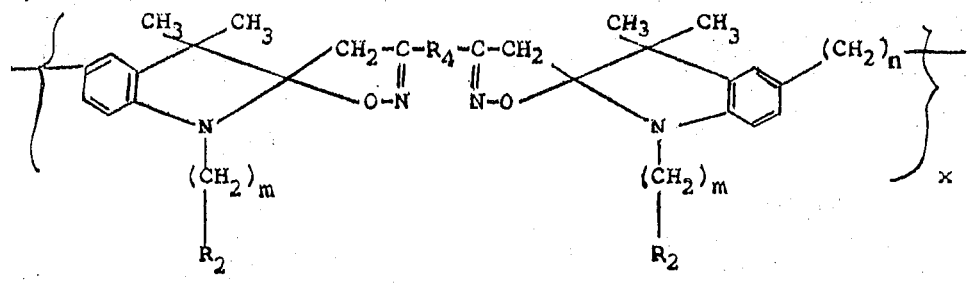

wherein $R_1$ is hydrogen atom, halogen atom, alkyl group having 1 to 4 carbon atoms, alkoxy group having 1 to 4 carbpn atoms, alkoxycarbonyl group having alkyl group of 1 to 4 carbon atoms, nitro group, or alkylene group having 1 to 3 carbon atoms, $R_2$ is hydrogen atom, hydroxyl group, alkoxycarbonyl group having alkyl group of 1 to 4 carbon atoms, cyano or phenyl group, $R_3$ is hydrogen atom, halogen atom, alkyl group having 1 to 4 carbon atoms, or alkoxy group having 1 to 4 carbon atoms, $R_4$ is direct bond of carbon atoms, methylene group having 1 to 3 carbon atoms or phenylene group, *m* is an integer from 1 to 4, *n* is an integer from 0 to 2 and *x* is the degree of polymerization and is an integer ranging from 5 to 100.

Compounds represented by the above formulae are novel compounds prepared by addition reactions of 2-methylene-indoline derivatives with nitrile oxides. Nitrile oxides are active intermediates produced by reacting hydroxamic acid halides with bases and provide ring compounds by 4,3-dipolar cycloaddition to multiple bonds such as acetylene, nitrile, carbonyl, olefin and the like. The mechanism of these reactions is known as dipole ring formation reaction, and concerning it R. Huisgen wrote general considerations in Angewandte Chemie, 75, 604 (1963). Recent synthesis of polymers containing heterocycles utilizing the 1,3-dipolar cycloaddition reaction were reported, for instance, see Iwakura, Shiraishi, et al. Bulletin of the Chemical Society of Japan, 38, 335 (1965); ibid., 38, 513 (1965); and Polymer Letters, 4, 305 (1966) etc.

With reference to these reports, many addition products were obtained by reacting various 2-methyleneindolines with various hydroxamic acid halides in the presence of a base. It was proved that the structure of these addition products is a spiro (indoline-2,5′-isoxazoline) structure from the results of elemental analysis and measurements of infrared absorption spectrum, ultraviolet absorption spectrum, visible ray absorption spectrum, NMR spectrum, etc. For instance 1,3,3-trimethyl-2-methylene-5-chloroindoline and benzhydroxamine acid chloride were dissolved in ether. To the solution was added dropwise, 1N sodium hydroxide solution and the mixture was stirred at room temperature for 30 minutes. Then the ether layer was dried and concentrated, in reduced pressure and crystals were obtained.

The thus isolated compound was colorless and needle-like and had a melting point of 167° to 168°C and had the following results of elemental analysis: carbon 69.4%, hydrogen 5.86%, nitrogen 8.36%. The results were in good agreement with the theoretical value of 1,3,3-trimethyl-5-chloro-3′-phenyl-spiro (indoline-2,5′-isoxazoline) ($C_{19}H_{19}N_2OCL$): carbon 69.5%, hydrogen 5.86%, nitrogen 8.57%. Meanwhile, the agreement was supported by the fact that the parent peak ($M^+$) of a mass spectrum was 326, and the compound had the absorption in infrared absorption spectrum at 1560 $cm^{-1}$ which agreed with γc=N, and had a maximum absorption in Ultraviolet absorption spectrum at 262 mμ ($\epsilon = 2.58 \times 10^4$). On the basis of these absorption it was concluded that the compound had an indoline type structure altered from the methylene-indoline type structure starting material. Moreover, in NMR spectrum (tetramethylsilane dissolved in deuterated chloroform solution, internal reference) the compound had peaks at δ value (as p.p.m.) 1.25 (S, 3H), 1.34 (S, 3H), 2.61 (S. 3H), 3.03, 3.33, 3.38, 3.69, (AB type 2H|j| = 18.0 c.p.s.) and ring proteons (8H) were observed.

On the basis of above-mentioned data it is obvious that the compound of this invention has spiro (indoline-2,5′-isoxazoline) structure.

Meanwhile, a high polymer compound obtained by the reaction of 5,5′-methyl-enebis-(1,3,3-trimethyl-2-methylene-indoline) with dichloroglyoxime had a maximum absorption in ultraviolet absorption spectrum at 262 mμ, and in NMR spectrum the high molecular compound had peaks at δ value 1.24 (S), 137 (S), 2.66 (S), 3.01, 3.34, 3.67 (Transition type to $A_2$ type from AB type) and multiplate ring protons (8H). The intensity ratio of these peaks was 6:6:4:2:6, and the infrared absorption spectrum also agreed nearly with spectrum of the above mentioned mono-spiro-compound. From these data it is obvious that the high molecular compound of this invention has a structure containing spiro-(indoline-2,5′-isoxazoline) as a repetition unit.

In this invention, it was found that the many compounds which were prepared and which had structures which were confirmed as stated above are useful as organic photoconductive materials for electrophotography. These compounds are listed in Table 1 to Table 4.

The high molecular compounds of this invention are soluble in various organic solvents such as chloroform, tetrahydrofuran, N,N-dimethylformamide, N,N-dimethyl-acetamide, N-methyl-2-pyrrolidone and the like, and are so highly polymerized that they give a strong film by applying a solution of the polymer in a lower boiling solvent such as tetrahydrofuran to a metallic plate and drying, and their reduced viscosity value ($\eta sp/c$) was about from 0.03 to 0.6.

Table 1

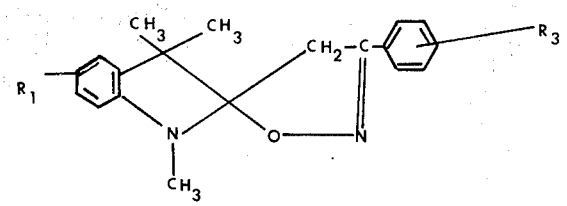

| Compound No. | $R_1$ | $R_3$ | M.P. (°C) | λ $CHCl_3$ max | (mμ), (ε) |
|---|---|---|---|---|---|
| 1 | —H | —H | 118 | 260 | ($1.95\times10^4$) |
| 2 | —Cl | —H | 167–168 | 262 | ($2.56\times10^4$) |
| 3 | —H | —Cl | 170–171 | 268 | ($2.18\times10^4$) |
| 4 | $C_2H_5OCO$— | —H | 123–124 | 304 | ($3.07\times10^4$) |
| 5 | —$NO_2$ | —Cl | 184–185 | 265 | ($2.16\times10^4$) |
| | | | | 372 | ($2.04\times10^4$) |
| 6 | —$NO_2$ | —H | 210.5–211.5 | 260 | ($1.83\times10^4$) |
| | | | | 373 | ($2.13\times10^4$) |
| 7 | $CH_3O$— | —H | 155 | 259 | ($1.94\times10^4$) |
| 8 | —H | —$CH_3$ | 140 | 260 | ($2.05\times10^4$) |

Table 2

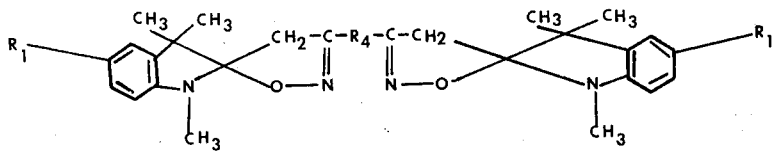

| Compound No. | $R_1$ | $R_4$ | M.P.(°C) | λ $CHCl_3$ max | (mμ) , (ε) |
|---|---|---|---|---|---|
| 9 | —H | direct bond of carbon atoms | 231 | 259 | ($3.06\times10^4$) |
| 10 | —Cl | " | 154 | 262 | ($4.06\times10^4$) |
| 11 | $C_2H_5OCO$— | " | 242 | 305 | ($4.64\times10^4$) |
| 12 | —H | —$CH_2$— | 200 | 259 | ($3.30\times10^4$) |
| 13 | —H | (—$CH_2$—)$_3$ | 185 | 259 | ($3.21\times10^4$) |
| 14 | —H | 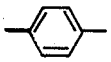 | 273 | 299 | ($3.30\times10^4$) |

Table 3

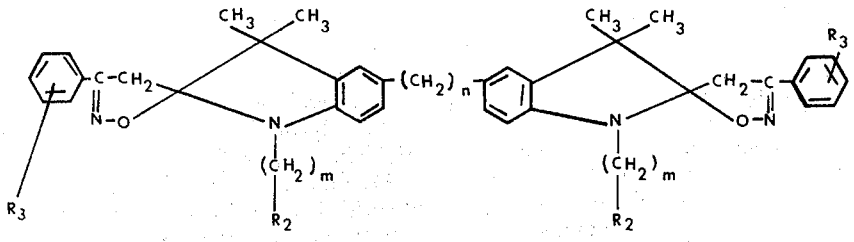

| Compound No. | n | m | $R_2$ | $R_3$ | M.P. (°C) | λ $CHCl_3$ max | (mμ) 1(ε) |
|---|---|---|---|---|---|---|---|
| 16 | 0 | 2 | —$COOC_2H_5$ | —H | 210 | 265 | ($5.78\times10^4$) |

Table 3-continued

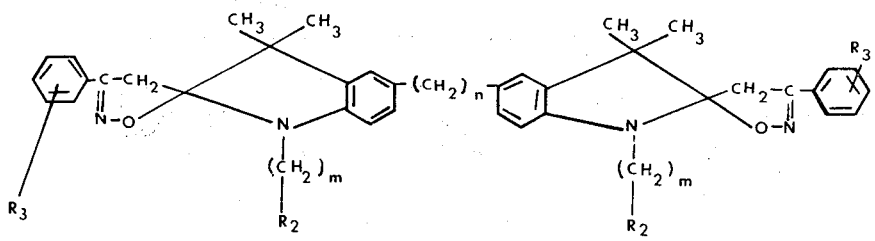

| Compound No. | n | m | $R_2$ | $R_3$ | M.P. (°C) | λ $CHCl_3$ max | (mμ) l(ε) |
|---|---|---|---|---|---|---|---|
| 17 | 1 | 1 | —H | —H | 196 | 264 | ($4.32\times10^4$) |
| 18 | 1 | 1 | —H | P—Cl— | 250 | 274 | ($3.97\times10^4$) |

Table 4

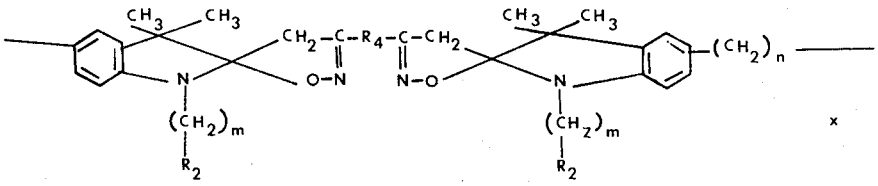

| Compound No. | n | m | $R_2$ | $r_4$ | Reaction Time(Hr) | Yield (%) | M.P. (°C) | ηsp/c solvent |
|---|---|---|---|---|---|---|---|---|
| 19 | 0 | 1 | —H | direct bond of carbon atoms | 1 | 80 | 273—275 | 0.15(THF) |
| 20 | 1 | 1 | —H | " | 20/60 | 90 | above 300 | 0.49(THF) |
| 21 | 1 | 1 | —H | " | 3 | 90 | 230–240 | 0.11(THF) |
| 22 | 1 | 2 | $-CO_2C_2H_5$ | " | 20/60 | 70 | 174–185 | 0.06(THF) |
| 23 | 1 | 1 | —H | 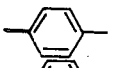 | 1 | 90 | 300 | 0.27(NMP) |
| 24 | 0 | 1 | —H | 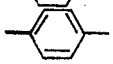 | 20/60 | quantitative | 300 | Impossible to measure |
| 25 | 1 | 1 | —H | 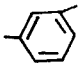 | 1 | 80 | above 300 | 0.15(NMP) |
| 26 | 0 | 3 | —CN | direct bond of carbon atoms | 1 | 90 | above 300 | 0.11(THF) |
| 27 | 2 | 2 | —OH | " | 1 | 50 | 250–270 | 0.07(THF) |

For utilizing lower molecular compounds which were abovementioned as materials for electrophotography, coatings for use as a light-sensitive layer are made by dissolving the compounds in organic solvents with highly insulating coating-forming resinous binders, applying the solutions to comparatively electroconductive supports and drying, if desired. It is also possible to add plasticizers and sensitizers to improve the characteristics of the coatings and to increase greatly the sensitivity. In the case of high molecular compounds listed in Table 4, coatings for use as a light-sensitive layer are made by dissolving the high molecular compounds in organic solvents without highly insulating coating-forming resinous binder, applying the solution to a comparatively electroconductive supports and drying, if desired. It is also possible to add plasticizers and sensitizers to improve the characteristics of the coatings and to increase greatly the sensitivity.

As coating-forming resinous binders, styrene-butadiene copolymers, polystyrenes, chlorinated rubbers, polyvinyl chlorides, vinyl chloride/vinyl acetate copolymers, polyvinylidene chloride, nitrocelluloses, polyvinyl acetates, polyvinylacetals, polyvinyl ethers, silicon resins, methacrylic resins, acrylic resins, phenol resins, alkyd resins, urea/aldehyde resins, etc. may be used, and as electroconductive supports, metallic plates, electroconductive papers, electroconductive plastic films, etc. may be used, and as plasticizers chlorinated biphenyls, chlorinated paraffins, phosphate plasticizers, phthalate plasticizers, etc. may be used, and as sensitizers, conventional sensitizers such as tetracyanoethylene, tetracyanoquinodimethane, chloranil, naphthoquinone, anthraquinone, Methylene Blue, Crystal Violet and Malachite Green, etc. may be used.

It is preferred to suitably combine these materials and apply them on an electroconductive support to provide a dried coat of 2 to 20 microns in thickness. When the organophotoconductive component is more than 25 percent of the total components of the coating, electrophotographically excellent characteristics are obtained.

The light-sensitive layer obtained by the above-mentioned process is uniformly charged by corona discharge according to the conventional method of electrophotography, and after image-exposure is developed by cascade development, liquid development, etc. In the case of cascade development it may be fixed by weakly heating after development or by standing in a solvent-vapor capable of dissolving the resin of toner.

This invention is further illustrated by the following examples, however, this invention shall not be limited to the following examples.

EXAMPLE 1.

Half a gram of compound No. 1 in Table 1 and 20 ml of 10 percent polystyrene solution in tetrahydrofuran were blended uniformly, the resulting solution was applied to an aluminum plate support to provide a dried coating of 0.5 micron thickness.

After drying it was charged with positive electricity in a dark place, and a positive picture film was placed upon it, then they were exposed with a high-pressure mercury lamp (Toshiba, SHL-100) from 30 cm height for about 5 seconds. Then it was developed with a toner charged with negative electricity (for instance developer for Xerox 914), whereby a positive picture was developed, and standed in an atmosphere of trichloroethylene for fixation, whereby a clear positive image was obtained.

EXAMPLE 2.

Compound No. 2 in Table 1 was applied and dried as described in Example 1. After exposure for 2 seconds similar treatments were repeated and a clear positive image was obtained.

EXAMPLE 3.

By treating compound No. 9 in the exactly similar manner of Example 1 a clear positive image was obtained.

EXAMPLE 4.

Compound No. 15 in Table 3 was applied and dried as described in Example 1. After exposure for about 1 second similar treatments were repeated and a clear positive image was obtained.

EXAMPLE 5.

Half a gram of compound No. 21 in Table 4 was dissolved in 3 ml of tetrahydrofuran, then the solution was applied to an aluminum plate to provide a dried coating of 5 microns thickness. This test plate was exposed for about 1 second as described in Example. and by treating as in Example 1 a clear positive image was obtained.

EXAMPLE 6

A similar test plate as in Example 5 was charged with positive electricity in a dark place, and a positive image film was placed upon it, then they were exposed with a 100 W. tungsten lamp (Toshiba lamp) from 30 cm height and then by treating as described in Example 1 a clear positive image was obtained.

EXAMPLE 7.

Half a gram of Compound 23 in Table 4 was dissolved in 4 ml of tetrahydrofuran. After separation of a small amount of insoluble substances, the solution was applied as described in Example 5 and the test plate was exposed for about 3 seconds as in Example 6. Further treatments as described in Example 1 gave a clear image.

EXAMPLE 8.

A test plate of Example 7 was charged with electricity in a dark place and overlayed with a positive image film. Then they were exposed with a diazotype duplicator (for instance Recopy-standard), a diazo-type wet copying machine equipped with a mercury lamp and manufactured by Ricoh Kabushiki, Kaisha, Japan, at full reproduction speed (for instance in the case of Recopy-standard, the dial was set at 20). Further treatments as described in Example 1 gave a clear image.

EXAMPLE 9.

To the solution of Example 7 was added 0.001 g of chloranil, and similarly in Example 7 the solution was applied and the test plate was exposed, developed and fixed. When the exposure time was less than even 1 second, a clear image was obtained.

The organic photoconductive compounds, of this invention have been prepared by the present inventors and the process for the preparation is disclosed in copending U.S. Pat. application Ser. No. 185,818 (filed Oct. 1, 1971), and Japanese Patent Publication 7101/73.

The process comprises reacting 1,3,3-substituted-2-methylinodolenium salt, 1,3,3-substituted-2-methyleneindoline, bis(1,3,3-substituted-2-methylindolenium salt), bis-(1,3,3-substituted-2-methyleneindoline), etc. corresponding to monomers, bis compounds and polymer compounds with hydroxamic acid chlorides or bifunctional hydroxamic acid chlorides in the presence of a base.

The 2-methylene indolines are certain derivatives of Fischar's Base (1,3,3-trimethyl-2-methyleneindoline) which is well known in the field of dyes, and can generally be prepared by reacting 2-methylindolenine with a conventional alkylating agent, an alkylsulfonic acid ester or the like to obtain the corresponding indolenium salt and then reacting the resulting indolenium salt with a base.

The 2-methyleneindolines are generally unstable in air and the above U.S. Ser. No. 185,.18 and Japanese Patent Publication 7101/73 also discloses a process for preparing the compounds of this invention from the precursor, indolenium salt.

The spiro (indoline-isoxazoline) compounds can be prepared by an addition reaction between nitrile oxide and 2-methyleneindoline.

The 2-methyleneindolines and the precursors thereof include the following compounds:

Examples of indolenum salts are 1,2,3,3-tetramethylindolenium-p-tosytate, 1-β-hydroxyethyl-2,3,3-trimethylindolenium bromide, 1,2,3,3,5-pentamethyl-indolenium-p-tosylate, 1,2,3,3-tetramethyl-5-nitro-indolenium-p-tosylate, 5,5′-bis-(1,2,3,3-tetramethylindolenium-o-tosylate), 5,5′-bis-(1-β-hydroxyethyl-2,3,3-trimethylindolenium-p-tosylate) 5,5′-methylene-bis-(1-ethyl-2,3,3-trimethylindoleniumiodide),5,5′-methylene-bis-(1-cyanopropyl-2,3,3-trimethylindolenium-p-tosylate) and the like. Examples of 2-methyleneindolines are Fischer's base (1,3,3-trimethyl-2-methyleneindoline), 1,3,3-trimethyl-2-methylene-5-chlorindoline, 1-ethyl-2-methy--3,3-dimethyl-5-methoxyindoline,5,5′-bis(1,3,3-trimethyl-2-methyleneindoline), 5,5′-methylene-bis(1,3,3-trimethyl-2-methyleneindoline), bis(1,β-ethoxycarbonyl-2-methylene-3,3-dimethylindoline), 5,5′-bis)1-β; hydroxyethyl-2-methylene-3,3-dimethylindoline) and the like.

The bis-indolenies (2) are prepared by the above Fischer's Indole Synthesis of bis-phenylhydrazines which are prepared from bisanilines by the method shown below:

The preparation of an indolenium salt from indolenine and the preparation of 2-methylindoline are shown by the formula (3) and (4), respectively.

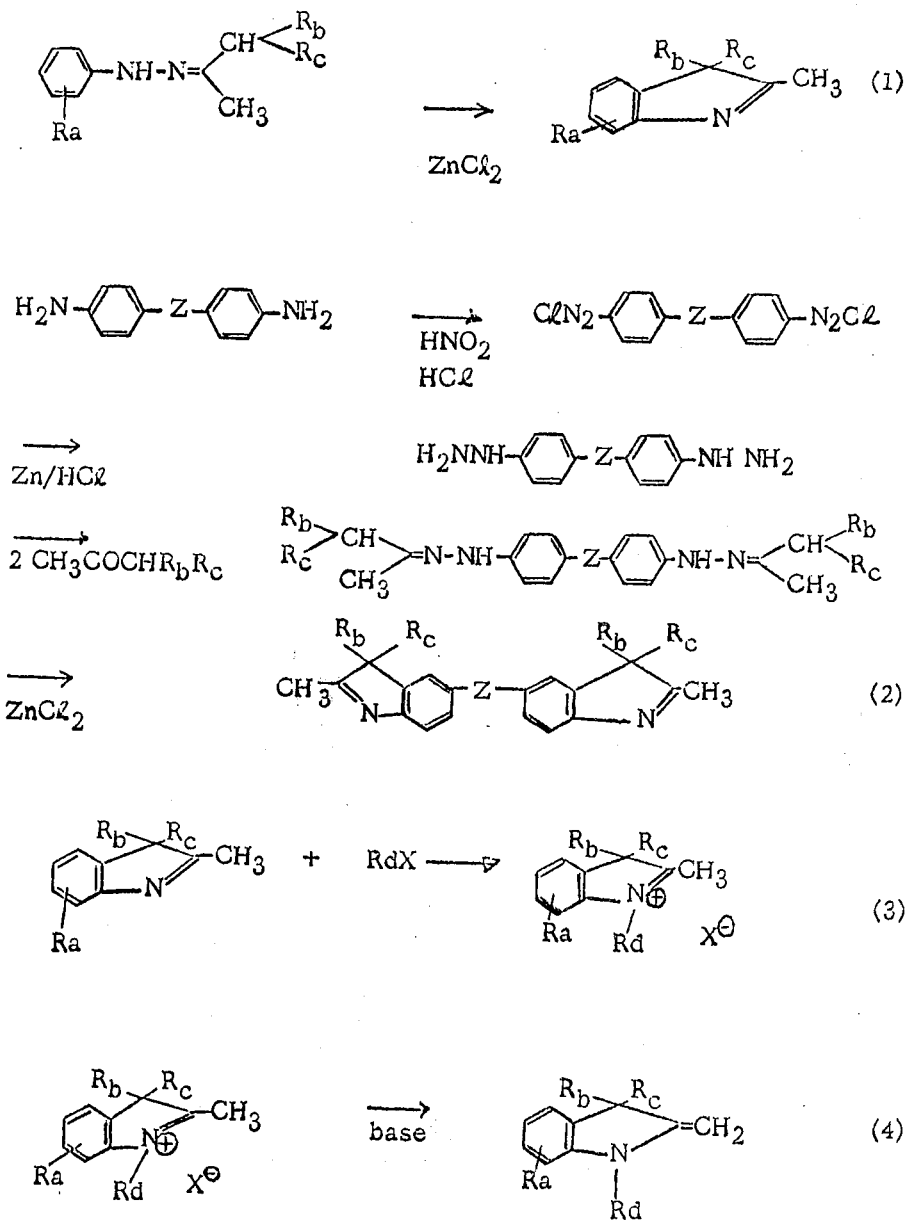

wherein Z represents a bridge between the aromatic nuclei and X represents a conjugate base.

The reactions of methyl-indolines are described in the following reference:

"CHEMISTRY," June, 1953, pages 505–512, published by Riko Publishing Co.

The above reference describes on page 508 the synthesis of Fischer's Base from hydrazine.

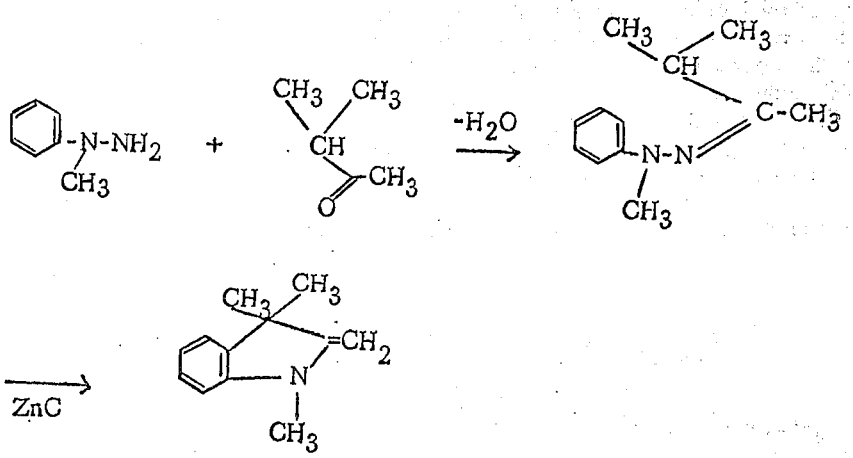

Fischer's Base (1,3,3-trimethyl-2-methyleneindoline)

In the present invention, the methyleneindolines are generally synthesized by the process which is thought to be more convenient than that of the above process introducing various substituents into 1-position of the indoline maiety. That is, the process used in the present invention comprises converting an indolenine into an indolenium salt and treating the indolenium salt with a base, as shown in the above formulae (3) and (4). This process is apparently versatile as compared with the process for producing N-methyl-2-methylene-benzothiazole described on page 508 of the reference "CHEMISTRY" comprising quaternizing a 2-methylthiazole with methyl iodide and subsequently treating the resulting quaternary salt with a 40% aqueous sodium hydroxide.

Of the spiro (indoline-2,5′-isoxazoline) compounds (A), the high molecular weight compounds represented by the formula (IV) can be prepared by polyaddition reaction between a bifunctional 2-methyleneindoline and a bifunctional nitrile oxide.

This reaction is based on a 1,3-dipolar addition reaction between 2-methyleneindoline and nitrile oxide and, therefore, is a stepwise polymerization differning from the chain reaction of a vinyl polymerization type. The stepwise polymerization is described in detail in Brillmeyer, Jr., "Textbook of Polymer Science," Chapter 8, recited above. In particular, reference can be made to pages 264–271 (a copy is enclosed) as to the molecular weight.

On page 268 of the reference, the following equations (8-7), (8-8) and (8-9) are shown:

$$Nx = N_p^{x-1}(1-P) \qquad (8\text{-}7)$$

$Nx$ : Total number of X-mers $N$ : Total number of molecules present $P$ : Fraction of the functional groups $$Nx = No\,(1-P)^2P^{x-1} \qquad (8\text{-}8)$$

$No$ : Total number of unit $$N = No\,(1-P)$$

$$Wx = X\,\frac{Nx}{No} = X(1-P)^2P^{x-1} \qquad (8\text{-}9)$$

$Wx$ : Weight fraction of x-mers

The equation (8-8) and (8-9) lead FIGS. 8–3 on page 268 and FIGS. 8–4 on page 268.

It is understood from the above figures, that in bifunctional stepwise polymerization, the degree of polymerization would be 10 at a 90 percent reaction and at most 100 at a 99 percent reaction, but the degree of polymerization would be distributed over a wide range.

In the light of the above, it should be appreciated that the high molecular weight compounds disclosed in the present invention have a degree of polymerization on the order of from 5 to 100 based on their reaction ratios.

What is claimed is:

1. An electrophotographic process comprising the steps of charging, image exposing and developing a member comprising a resin binder and a compound of formula (A) which is more than 25 percent of the total components of the member;

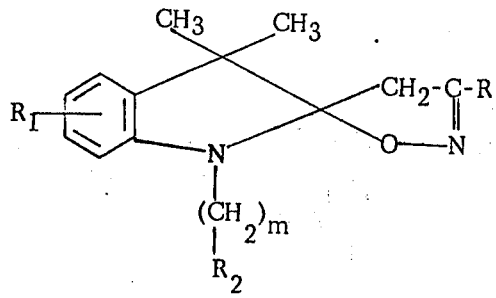

(A)

wherein $R_1$ is selected from the group consisting of an hydrogen atom, halogen atom, alkyl group having 1 to 4 carbon atoms, alkoxy group having 1 to 4 carbon atoms, alkoxycarbonyl group having an alkyl group of 1 to 4 carbon atoms, nitro group, alkylene group having 1 to 3 carbon atoms which is able to make a bis-compound, and a bond which is able to make a bis-compound; $R_2$ is selected from the group consisting of an hydrogen atom, hydroxyl group, alkoxycarbonyl group having alkyl group of 1 to 4 carbon atoms, cyano group and a phenyl group; R is selected from the group consisting of a substituted phenyl group (where the substituted group is selected from the group consisting of an hydrogen atom, halogen atom, alkyl group having 1 to 4 carbon atoms, and an alkoxy group having 1 to 4 carbon atoms), alkylene group having 1 to 3 carbon atoms which is able to make a bis-compound, phenylene group which is able to make a bis-compound, and a bond which is able to make a bis-compound; and *m* is an integer from 1 to 4.

2. An electrophotographic process as in claim 1 where said member includes a sensitizer.

3. An electrophotographic process as in claim 1 where said member includes a plasticizer.

4. An electrophotographic process including the steps of charging, image exposing and developing a member comprising a resin binder and a compound of the formula (I) which is more than 25 percent of the total components of the member, (I)

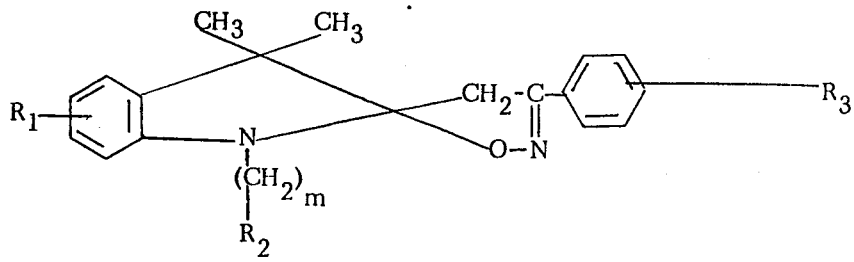

wherein $R_1$ is selected from the group consisting of an hydrogen atom, halogen atom, alkyl group having 1 to 4 carbon atoms, alkoxy group having 1 to 4 carbon atoms, alkoxycarbonyl group having alkyl group of 1 to 4 carbon atoms and a nitro group, $R_2$ is selected from the group consisting of an hydrogen atom, hydroxyl group, alkoxycarbonyl group having alkyl group of 1 to 4 carbon atoms, cyano and a phenyl group, $R_3$ is selected from the group consisting of an hydrogen atom, halogen atom, alkyl group having 1 to 4 carbon atoms, and an alkoxy group having 1 to 4 carbon atoms, and *m* is an integer from 1 to 4.

5. An electrophotographic method comprising the steps of charging, image exposing, and developing a member comprising a resin binder and a compound of the formula (II) which is more than 25 percent of the total components of the member;

(II)

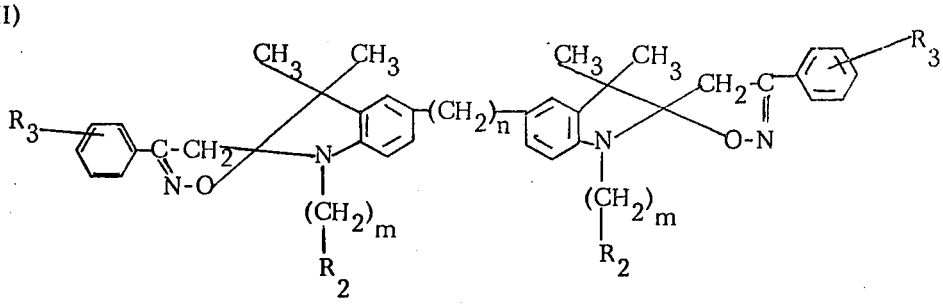

wherein $R_2$ is selected from the group consisting of an hydrogen atom, hydroxyl group, alkoxycarbonyl group having alkyl group of 1 to 4 carbon atoms, cyano and a phenyl group, $R_3$ is selected from the group consisting of an hydrogen atom, halogen atom, alkyl group having 1 to 4 carbon atoms and an alkoxy group having 1 to 4 carbon atoms, *m* is an integer from 1 to 4, and *n* is an integer from 0 to 2.

6. An electrophotographic method comprising the steps of charging, image exposing and developing a member comprising a resin binder and a compound of the formula (III) which is more than 25 percent of the total components of the member;

(III)

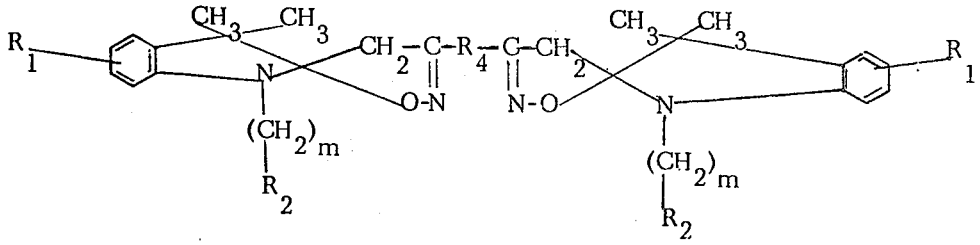

wherein $R_1$ is selected from the group consisting of an hydrogen atom, halogen atom, alkyl group having 1 to 4 carbon atoms, alkoxy group having 1 to 4 carbon atoms, alkoxycarbonyl group having alkyl group of 1 to 4 carbon atoms and a nitro group, $R_2$ is selected from the group consisting of an hydrogen atom, hydroxyl group, alkoxycarbonyl group having alkyl group of 1 to 4 carbon atoms, cyano and a phenyl group, $R_4$ is selected from the group consisting of a direct bond of carbon atoms, alkylene group having 1 to 3 carbon atoms which is capable of forming a bis-compound and a phenylene group which is capable of forming a bis-compound, and *m* is an integer from 1 to 4.

(IV)

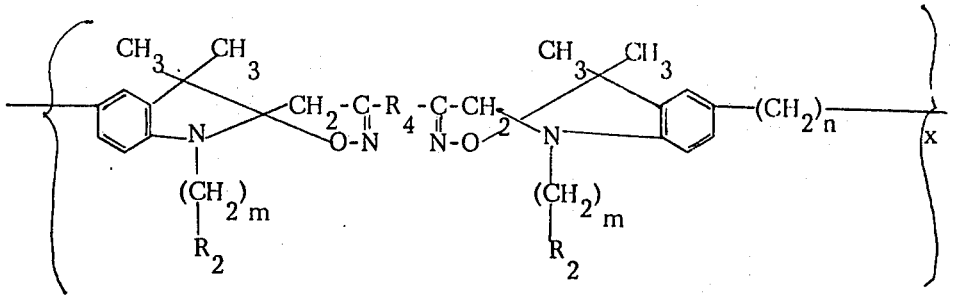

7. An electrophotographic method comprising the steps of charging, image exposing, and developing a member comprising a compound of the formula (IV) which is more than 25 percent of the total components of the member;

wherein $R_2$ is selected from the group consisting of an hydrogen atom, hydroxyl group, alkoxycarbonyl group having alkyl group of 1 to 4 carbon atoms, cyano and a phenyl group, $R_4$ is selected from the group consisting of a direct bond of carbon atoms, alkylene group having 1 to 3 carbon atoms which is capable of forming a bis-compound and a phenylene group which is capable of forming a bis-compound, *m* is an integer from 1 to 4, *n* is an integer from 0 to 2, and *x* is an integer from 5 to 100.

8. An electrophotographic method as in claim 7 where said member further comprises a resin binder.

* * * * *